United States Patent [19]

Gratzer et al.

[11] 4,414,834

[45] Nov. 15, 1983

[54] METHOD FOR EXPANDING TUBULAR BLANKS

[75] Inventors: Nelson R. Gratzer, Liverpool; William E. Wright, East Syracuse, both of N.Y.

[73] Assignee: Carrier Corporation, Syracuse, N.Y.

[21] Appl. No.: 461,091

[22] Filed: Jan. 26, 1983

Related U.S. Application Data

[63] Continuation of Ser. No. 231,641, Feb. 5, 1981.

[51] Int. Cl.[3] ..... B21D 26/04

[52] U.S. Cl. ..... 72/58; 29/421 R; 72/62

[58] Field of Search ..... 72/58, 61, 62, 63; 29/421 R

[56] References Cited

U.S. PATENT DOCUMENTS

| | | | |
|---|---|---|---|
| 3,335,590 | 8/1967 | Early | 72/58 |
| 3,564,886 | 2/1971 | Nakamura | 72/62 |
| 3,585,828 | 6/1971 | Roper | 72/63 |
| 3,675,457 | 7/1972 | Marsch | 72/58 |
| 3,681,960 | 8/1972 | Tadokoro | 72/61 |
| 3,706,213 | 12/1972 | Nakamura | 72/58 |
| 4,062,215 | 12/1977 | Roper | 72/62 |
| 4,173,136 | 11/1979 | Schroth | 72/58 |

*Primary Examiner*—Leon Gilden

*Attorney, Agent, or Firm*—Robert P. Hayter

[57] ABSTRACT

A method and apparatus for expanding a tubular workpiece which includes mounting the workpiece in a lower die, filling the workpiece with fluid and engaging the upper portion of the workpiece with an upper die. The upper die is moved downwardly acting to physically compress the workpiece. The dies are additionally configured to form an internal pressure cavity such that further downward displacement of the upper die creates an internal pressure forcing the workpiece outwardly into the desired end configuration.

4 Claims, 5 Drawing Figures

METHOD FOR EXPANDING TUBULAR BLANKS

This application is a continuation of application Ser. No. 231,641, filed Feb. 5, 1981.

BACKGROUND OF THE INVENTION

1. Field of the Invention

The present invention relates to a method and apparatus for expanding a tubular workpiece. More specifically, the present invention concerns a method and apparatus for simultaneously compressing and expanding a tubular workpiece to form a configuration having greatly extended portions.

2. Prior Art

To form deeply drawn cylindrical components has long created potential problems. Mechanical drawing utilizing a die and punch has physical and material limitations. Deep drawing done mechanically results in a thinning of material requiring greater initial thickness to allow for thinning and requiring materials adapted to drawing and capable of being drawn without unduly work hardening and without a susceptibility to stress cracking.

To avoid the problems of mechanical drawing the utilization of expansion equipment has been developed. Originally, a series of spaced expandable elements were placed within a workpiece and all forced outwardly acting as a series of mechanical punches to expand a component. Thereafter, an expansion process incorporating a bladder inserted within the workpiece was developed. This bladder was filled with a fluid to expand the workpiece outwardly into a die.

When an even deeper draw then those formed as above was desired it was ascertained that a workpiece may have a compressive force applied to it at the same time internal pressure is created to allow the material to flow while being expanded outwardly by the internal pressure. The present invention incorporates the use of compressive force with an internal force by utilizing a die arrangement which upon physical displacement creates a mechanical compressive force and also creates an internal pressure by mechanically inserting a portion of the die into a pressure cavity. The fluid within that cavity is pressurized and acts to expand the workpiece outwardly simultaneously with the workpiece being compressed.

SUMMARY OF THE INVENTION

It is the object of the present invention to provide a method for forming an expanded tubular workpiece.

It is a further object of the present invention to provide a method of manufacture wherein a workpiece may be expanded outwardly with insignificant necking of the workpiece.

It is a further object of the present invention to provide a method of forming a workpiece wherein a compressive force as well as an internal hydraulic force are created by movement of two dies relative to each other.

It is a further object of the present invention to provide a safe, economical and reliable manufacturing method for forming deeply expanded cylindrical workpieces.

Other objects will be apparent from the description to follow and the appended claims.

The preceding objects are achieved according to the preferred embodiment of the invention by the provision of a hydraulic press having a fixed bed and a movable bed. A first die is mounted to the fixed bed and has workpiece support ledges to which the workpiece is engaged. Fluid supply means are additionally provided for directing fluid into the interior of the workpiece. A second die is attached to the movable bed and has displacement portions extending downwardly therefrom as well as a top workpiece support ledge.

The cylindrical workpiece is placed on the workpiece support ledges of the lower die and filled with fluid. The upper die is then lowered such that the top workpiece support ledge engages the top of the workpiece and begins to compress same. The two dies and workpiece define a pressure cavity with the displacement portion of the upper die extending into this cavity to create an internal pressure which forces the workpiece outwardly. The upper and lower dies define the shape to whch the workpiece is to be configured.

The upper die is moved towards the lower die until the appropriate workpiece height is formed and the appropriate displacement of the workpiece outwardly is completed. Thereafter the upper die is removed and the workpiece disengaged. Should the internal pressure created by the forcing of the displacement portion into the pressure cavity be insufficient to expand the workpiece fully then additional fluid may be pumped into the pressure cavity at high pressure to create such displacement.

DESCRIPTION OF THE PREFERRED EMBODIMENT

The embodiment as described herein discloses particular dies arranged in a hydraulic press to create a particular workpiece configuration. It is to be understood that the type of press involved, the selection of which die is movable and the selection of die surfaces to form particular configurations, are all matters of choice to the designer.

Figure 1:
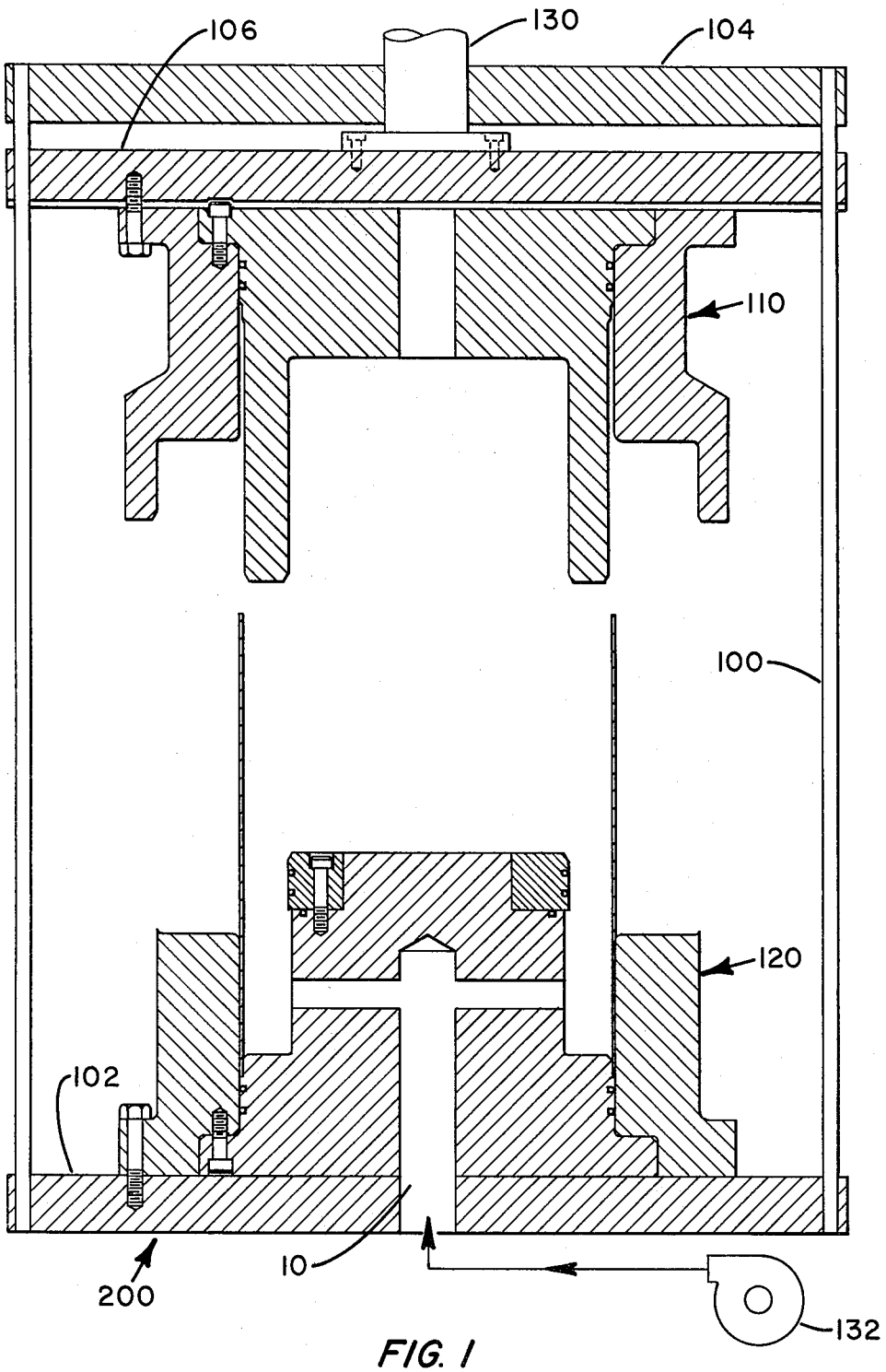
FIG. 1 is a sectional view of a hydraulic press showing the location of the dies.

Referring to FIG. 1 there may be seen a hydraulic press 200 having a fixed bed 102 and a crown 104. Guide rods 100 extend from the fixed bed to the crown and act to maintain movable bed 106 in relative position with fixed bed 102. Lower die 120 is shown secured to fixed bed 102 and has fluid supply 10 connected thereto. Pump 132 is shown for supplying fluid to lower die 120. Hydraulic cylinder 130 is shown extending through crown 104 to engage movable bed 106. Upper die 110 is mounted to movable bed 106 such that the application of hydraulic fluid to hydraulic cylinder 130 may cause movable bed 106 to move upwardly and downwardly into relative engagement with lower die 120.

Figure 2:
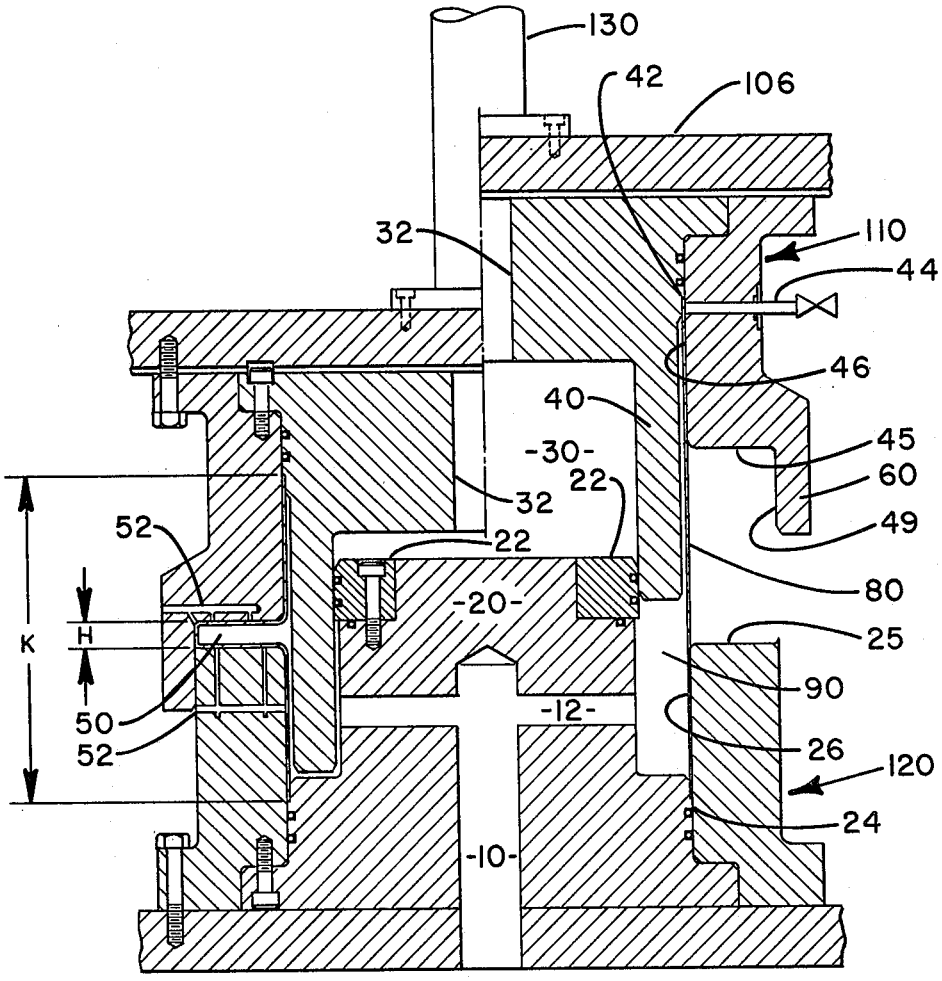
FIG. 2 is a bifurcated sectional view showing two dies, one positioned on the right hand side and a second fully closed positioned on the left hand side.

FIG. 2 is a segmented view showing the upper and lower dies with the upper die in two different positions. In the right hand side of the figure the upper die is in a position where it is just engaging the workpiece. On the left hand side of the figure the upper die is in a position where the workpiece is completely formed. Referring to the right hand side of the figure it is seen that the upper die 110 has a displacement portion 40 extending downwardly therefrom, a top workpiece support ledge 42 arranged to engage the end of workpiece 80 and an outer defining surface 46 to which the workpiece will be ultimately configured. Upper die 110 further includes an overlap portion 60 including top displacement surface 45 and outer displacement surface 49.

Lower die 120 has fluid supply 10 extending therethrough including fluid discharge line 12. Lower die 120 includes center portion 20 having seals 22 mounted about the circumference thereof for engaging with displacement portion 40 of upper die 110. Lower die 120 further includes workpiece support ledge 24 for securing the bottom of workpiece 80, outer defining surface 26 and bottom displacement surface 25.

Fluid supply 10, fluid discharge 12 and pressure cavity 90 form a closed volumetric area into which fluid is passed prior to the upper die being lowered. This pressure cavity is defined on the outward side by workpiece 80, at the top by displacement portion 40 and by center portion 20, fluid supply 10 and lower die 120. A center cavity 30 is formed above center portion 20 of the lower die and below the upper die between the displacement portions 40. Center bleed line 32 is provided to allow fluid within the center cavity 30 to be discharged therefrom. A vent 44 is shown for allowing excess fluid to be vented from the exterior of the workpiece.

On the left hand side of FIG. 2 it can be seen that workpiece 80 has been compressed and extends outwardly into the area defined by the top displacement surface 45, outer displacement surface 49 and bottom displacement surface 25 of the dies. It is top displacement surface 45, outer displacement surface 49 and bottom displacement surface 25 of the two dies which define displacement cavity 50. A portion of the die is cutaway to show cavity vent openings 52 which allow air trapped between the dies and the workpiece to be discharged such that the workpiece may be expanded into displacement cavity 50. Additionally it may be seen on the left hand portion that the depth of the displacement cavity is indicated as "H" and the length of the workpiece after being compressed and expanded is indicated as "K".

Figure 3:
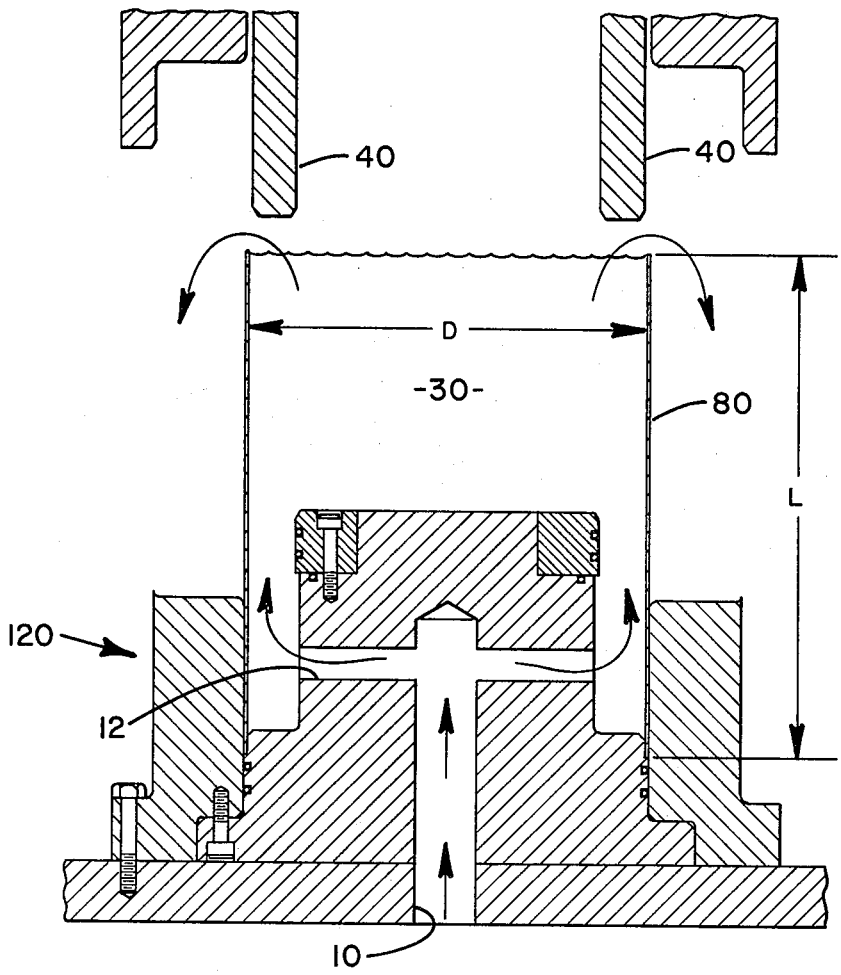
FIG. 3 is a sectional view showing a workpiece filled with water prior to the second die displacing any of the fluid.
Figure 4:
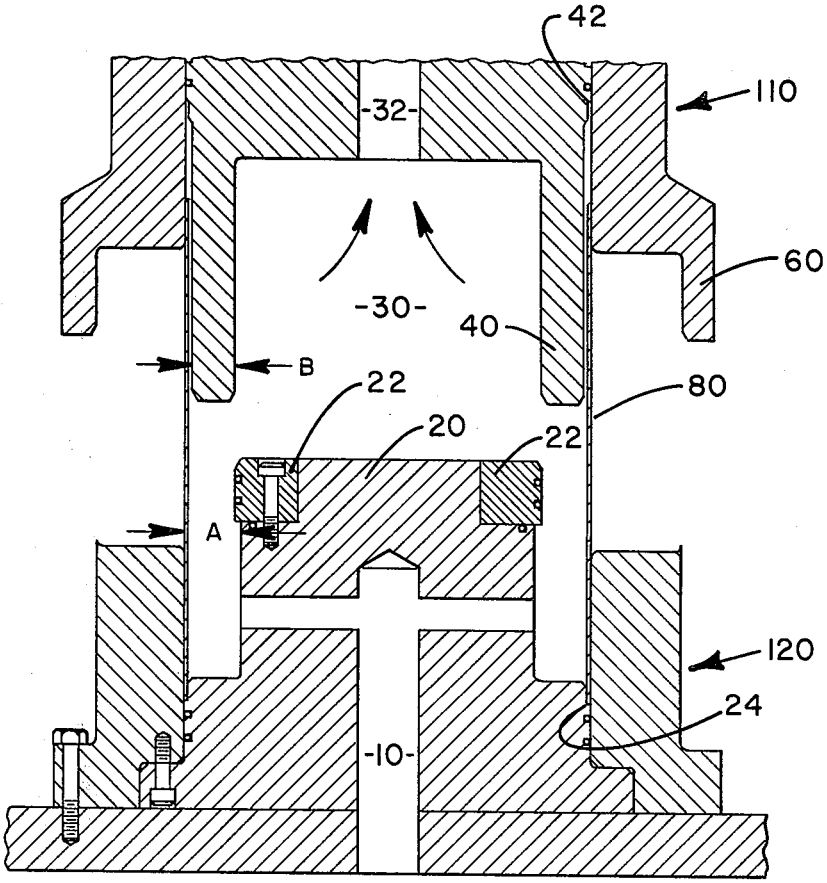
FIG. 4 is a sectional view showing the second die partially inserted into the workpiece.
Figure 5:
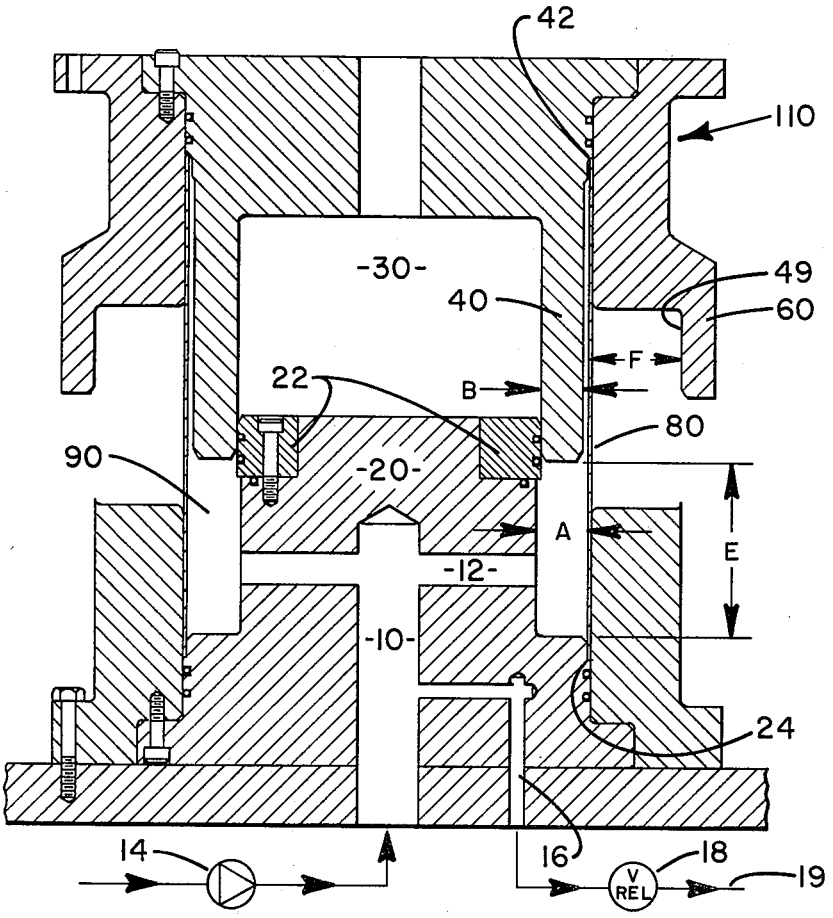
FIG. 5 is a sectional view showing the second die engaging the top of the work piece and displacement portions entering the pressure cavity.

FIGS. 3 through 5 show the two dies in relative positions during various increments of the expansion process. In FIG. 3 it can be seen that displacement portions 40 of the upper die are about to enter workpiece 80. As seen in FIG. 3 workpiece 80 has internal diameter "D" and length "L" prior to any work being accomplished. It can also be seen in FIG. 3 from the arrows therein that fluid flows upwardly through fluid supply 10 and out through fluid discharge lines 12 into the interior of the workpiece defined as center cavity 30. The fluid fills the workpiece entirely and flows over the outer edges thereof.

In FIG. 4 it can be seen that upper die 110 has been moved closer to lower die 120 such that the top of the workpiece 80 extends into a portion of upper die 110 between displacement portion 40 and overlap portion 60. Center cavity 30 has now been reduced in size and fluid flows out of the center cavity through center bleed line 32 and out of the cavity by flowing around the tops of the workpiece since the workpiece is not yet sealed by upper ledge 42. Additionally, as shown in FIG. 4 the width of the displacement portion is designated as "B" and the width of the portion between the seal 22 and the workpiece is designated as "A".

In FIG. 5 workpiece 80 is seated on top workpiece support ledge 42 of upper die 110. A pressure cavity 90 is now defined by the workpiece on the outer side, by lower die 120 and upper die 110. The pressure cavity 90 has a width between the center portion 20 and the workpiece designated as "A" which is greater than the width of the displacement portion 40 of upper die 110 designated as "B". At this particular point with the upper die just engaging the top of the workpiece with the top support ledge the distance between the lower die and the displacement portion is shown as distance "E" defining a portion of pressure cavity 90.

It may be seen that distance F is designated between the exterior of the workpiece and the outer displacement surface 49 of overlap portion 60 of the upper die.

In FIG. 5 it can also be seen that fluid supply 10 acting through discharge line 12 may have a one-way valve 14 located therein. This one-way valve allows water to flow into the center cavity 30 of the cylinder but not to be discharged therefrom. Additionally, a pressure relief line 16 with a timed valve 18 and discharge line 19 is shown connected to fluid supply 10. This combination may allow for limited discharge of fluids from the center cavity prior to complete insertion of the upper die or from the pressure cavity thereafter.

OPERATION

The workpiece is inserted into the lower die such that the bottom of the workpiece and the workpiece support ledge 24 form a seal. Water is then supplied through the fluid supply line 10 to fill the entire center cavity 30 defined by the workpiece. The workpiece filled with fluid is shown in FIG. 3. The upper die is then moved downwardly with the displacement portions entering the center cavity and fluid being displaced therefrom and flowing from the die to be collected elsewhere. As the die is moved further downwardly, as shown in FIG. 4, additional water is displaced which is directed out center bleed 32 and around the ends of the workpiece. As the upper die further progresses downwardly the top workpiece support ledge of the upper die engages the top of workpiece 80 and forms a seal therewith. At this point in time, as shown in FIG. 5, the internal cavity 30 is separated from pressure cavity 90 by the interaction of displacement portion 40 of the upper die with seals 22 of the center portion of the lower die. At this point center cavity 30 is independent from pressure cavity 90 and is vented to bleed outwardly through the center bleed line 32. The pressure cavity at this point is defined by fluid supply line 10, discharge line 12, and the space defined by the bottom of the displacement portion, the lower die and workpiece 80 including the space between workpiece 80 and displacement portion 40. This pressure cavity is of a known volume.

As the upper die is moved further downwardly the length "L" of the workpiece is decreased. Additionally, an internal pressure is created since the volume of the pressure cavity 90 is decreased by the further downward movement of displacement portion 40 decreasing the volume of pressure cavity 90. Distance "E" between the bottom of the displacement portion and the lower die 120 decreases. Since the fluid, typically water, utilized in pressure cavity 90 is substantially noncompressible, the workpiece 80 is forced outwardly against the outer defining surface 26 of the lower die and the outer defining surface 46 of the upper die and outwardly into displacement cavity 50.

As the die continues to move downwardly pressure cavity 90 continues to be modified and the workpiece is forced further and further outwardly. This process continues until the configuration as shown in the left hand portion of FIG. 2 is achieved. In this configuration the workpiece is fully displaced into displacement cavity 50 a distance "F" in depth from the original plane of the workpiece, said displacement cavity having height "H".

The original length of the workpiece "L" has been diminished to length "K". Under proper design conditions the original length "L" will equal exactly the final length "K" plus two lengths "F", the amount of displacement into displacement cavity 50. By maintaining the length of the workpiece in the configured shape the same as the original shape it is possible to arrive at the final shape without any necking or narrowing of the workpiece. By forming the workpiece without necking or narrowing it is possible to use thinner material since there is no degradation of thickness during the forming process.

The combination of the overlap portion 60 with the top displacement surface and outer displacement surface together with the bottom displacement surface 25 acts to define the displacement cavity 50 as the two dies mesh. Cavity vent openings 52 are provided in these areas to allow trapped gas to escape as the fluid pressure forces the workpiece outwardly.

During the advancement of the upper die toward the lower die and the displacement of fluid it would be optimum to have the volume of the pressure cavity, which is decreased by the insertion of the displacement portions, approximately equal to the volume of the displacement cavities created when the workpiece is forced outwardly. Under realistic conditions some overlap is required and hence some venting of fluid during the expansion is necessary. A timed valve 18, as shown in FIG. 5, may be utilized to allow some of the fluid to flow out of pressure cavity 90 during the expansion process. This valve may be timed upon a certain internal pressure being reached to allow the release of a fixed amount of fluid thereafter.

It has been found with some extremely complex configurations that the forming of a pressure cavity and the displacement of the workpiece by the utilization of a displacement portion to create internal pressure within that cavity results in insufficient displacement to form the displacement cavity portion. Under these conditions a pump, as shown as pump 132 in FIG. 1, may be utilized to add additional fluid at high pressure to pressure cavity 90. This additional fluid acts to displace the workpiece outwardly to the configuration desired under those conditions.

The present method allows for the forming of an expanded cylindrical workpiece wherein a compressive force is applied mechanically to the workpiece. Dies are configured such that the same displacement utilized to create a compressive force acts together with an internal pressure cavity which is formed by the dies to create internal pressure which allows for the outward displacement of the workpiece. Hence, it is the single physical displacement of a die which creates both the compressive force and internal pressure creating the outward displacement.

The invention has been described herein with reference to a specific embodiment thereof. It is to be understood that modifications and variations can be made within the spirit and scope of the invention.

What is claimed is:

1. A method of expanding a selected portion of a generally tubular workpiece which comprises the steps of:

mounting a first die and a second die in relative sliding engagement, said first die including supporting means for the workpiece and a cylindrical center portion projecting within and spaced from the workpiece and said second die including an annular projection portion sized to mate with the cylindrical center portion to form a seal therewith and a bleed opening to allow fluid in the center space defined by the annular projection portion to bleed therefrom;

placing the workpiece in the first die such that the supporting means secures the workpiece in position forming a seal between the workpiece and the first die, such that the center projection portion is located within the workpiece and such that the second die is not in contact with the first die or the workpiece;

filling the interior of the workpiece with a non-compressible fluid until the fluid overflows and all compressible gases are displaced;

displacing the second die towards the first die to engage the end of the workpiece to apply a compressive force to the workpiece, to have the annular projection portion mate with the center portion of the first die to define a pressure cavity filled with fluid between the workpiece, the center portion of the first die and the projection portion of the second die and to force the excess fluid within the workpiece and within the annular projection portion to bleed therefrom;

forming the workpiece by forcing the second die toward the first die thereby compressing the workpiece and placing the fluid in the pressure cavity under pressure to act to force the workpiece outwardly, the first and second dies together defining the desired workpiece configuration and the excess fluid within the annular projection being continually bled while the fluid within the pressurized cavity is sealed therewithin; and separating the die and removing the formed workpiece.

2. The method as set forth in claim 1 and further comprising after the step of forming the step of:

supplying high pressure fluid to the interior of the workpiece to further bulge the workpiece.

3. The method as set forth in claim 1 wherein the overall length of the workpieces remains approximately constant from before expansion to after expansion, whereby the steps of forming and displacing merely configure the shape of the workpiece without effecting any substantial narrowing of the thickness of the workpiece.

4. The method as set forth in claim 1 and further including during the step of forcing the step of:

venting the pressure cavity to allow fluid to escape to prevent premature pressure buildup.

* * * * *